US005348672A

United States Patent [19]

Ohkura et al.

[11] Patent Number: 5,348,672

[45] Date of Patent: Sep. 20, 1994

[54] WATER-SOLUBLE LUBRICANTS FOR HOT PLASTIC WORKING

[75] Inventors: Tadao Ohkura; Mamoru Ashida, both of Ohtsu, Japan

[73] Assignee: Nippon Graphite Industries Ltd., Ohts, Japan

[21] Appl. No.: 12,744

[22] Filed: Feb. 3, 1993

[30] Foreign Application Priority Data

Apr. 2, 1992 [JP] Japan ..... 4-080852

[51] Int. Cl.[5] ..... C01M 129/48

[52] U.S. Cl. ..... 252/42; 252/49.3; 252/49.5

[58] Field of Search ..... 252/41, 42, 49.3, 49.5

[56] References Cited

U.S. PATENT DOCUMENTS 2,959,547 11/1960 Bulldart ..... 252/49.3
3,298,953 1/1967 Moruay ..... 252/41
4,401,579 8/1983 Kratzcr ..... 252/17
4,409,113 10/1983 Bertell ..... 252/42
4,454,050 6/1984 Bertell ..... 252/42
5,072,067 12/1991 Koyama et al. ..... 252/49.3

FOREIGN PATENT DOCUMENTS 2046298 11/1980 United Kingdom .

*Primary Examiner*—Jacqueline V. Howard
*Attorney, Agent, or Firm*—Ladas & Parry

[57] ABSTRACT

A water-soluble lubricant for hot plastic working consists essentially of (a) 0.1–30% by weight of a resin powder having a particular particle size distribution, (b) 0.1–30% by weight in total of alkali metal salts of isophthalic acid and adipic acid, (c) 0.1–10% by weight of a water-soluble high polymer, and (d) the balance being water.

8 Claims, No Drawings

WATER-SOLUBLE LUBRICANTS FOR HOT PLASTIC WORKING

BACKGROUND OF THE INVENTION

1. Field of the Invention

This invention relates to a water-soluble lubricant for hot plastic working capable of using instead of a graphite- based lubricant in the hot plastic working such as forging, extrusion, drawing or the like.

2. Description of the Related Art

Up to the present, the oily or water-soluble graphite-based lubricant has been used in hot plastic working. The former lubricant is formed by adding an extreme pressure additive or a flux to a mineral oil and dispersing graphite thereinto, so that there is a fear of fuming or igniting through the oil in the hot plastic working, which causes problems in view of the operation environment or health. The latter lubricant is formed by dispersing graphite into water, so that there is no fear of fuming or igniting and the lubricity is good, but there is a problem of blackly contaminating the operation environment with graphite.

In order to solve the problems on the operation environment due to the oily and water-soluble graphite-based lubricants, it has been attempted to develop lubricants for hot plastic working using no graphite. For instance, there are a lubricant using an alkali metal salt of fumaric acid (Japanese Patent laid open No. 58-52395), a lubricant using an alkali metal salt of phthalic acid (Japanese Patent laid open No. 58-84898) and the like. In these lubricants, the problem with respect to the operation environment is solved because graphite is not used, but the lubricity is rather poor as compared with the graphite-based lubricant, so that seizuring is caused or defects are generated in products. Further, if a mold temperature is lower than that in the graphite-based lubricant, the formation of a lubricating film is considerably poor, so that sticking on the product, defects in the product and the like are caused and hence the product can not be put into use.

The lubricants using no graphite are poor in lubricity as compared with the graphite-based lubricant as mentioned above, so that it is necessary to more uniformly form a lubricating film having a given thickness in a mold as compared with the use of the graphite-based lubricant. In a lubricant using the alkali metal salt of fumaric acid or phthalic acid, however, a good lubricating film is formed in a mold at a temperature of 200°–300° C., but when the mold temperature exceeds 300° C., the adhesion to the mold is degraded due to the decomposition of organic adhesive and a good lubricating film is not obtained, and also when the mold temperature is lower than 200° C., an undesirably thinner film is only formed in the mold.

SUMMARY OF THE INVENTION

It is, therefore, an object of the invention to solve the aforementioned problems of the conventional lubricant using no graphite and to provide a lubricant for hot plastic working forming a good lubricating film in a mold at a temperature of 100°–400° C. and having an excellent lubricity.

The inventors have made various studies and experiments and found that the formation of good lubricating film in a mold at a temperature of 100°–400° C. is obtained by mixing a resin powder dispersed in water with alkali metal salts of isophthalic acid and adipic acid at a particular compounding ratio, and as a result the invention has been accomplished.

According to the invention, there is the provision of a water-soluble lubricant for hot plastic working consisting essentially of (a) 0.1–30% by weight of a resin powder having a particle size distribution that an average particle size is 0.1–10 μm and an amount of particles having a particle size of not more than 0.1 μm is not more than 5% by weight and an amount of particles having a particle size of not less than 10 μm is not more than 5% by weight, (b) 0.1–30% by weight in total of alkali metal salts of isophthalic acid and adipic acid, (c) 0.1–10% by weight of a water-soluble high polymer, and (d) the balance being water.

When the lubricant according to the invention is actually used, it is further diluted with water so as to have a content of resin powder of 0.1–3.0% by weight.

DESCRIPTION OF THE PREFERRED EMBODIMENTS

As the resin powder used in the invention, mention may be made of cellulose resin, acrylic resin, polyethylene resin, epoxy resin, phenolic resin, polyester resin, allyl resin, melamine cyanurate resin and the like.

As the resin powder, use may be made of commercially available ones, but it is necessary to have such a particle size distribution that an average particle size is 0.1–10 μm and an amount of particles having a particle size of not more than 0.1 μm is not more than 5% by weight and an amount of particles having a particle size of not less than 10 μm is not more than 5% by weight. When the average particle size is less than 0.1 μm, or when the amount of particles having a particle size of not more than 0.1 μm is more than 5% by weight, oxidative destruction of the resin becomes faster in the hot plastic working to lower the adhesion property to a mold, and hence a uniform lubricating film is not obtained. Moreover, the release properties of the film are degraded which results in galling, sticking and the like. On the other hand, when the particle size is more than 10 μm, or when the amount of particles having a particle size of not less than 10 μm is more than 5% by weight, if working machines are stopped during holidays or the like, settlement, deposition and the like of the resin powder are apt to be caused in pipes for supplying the lubricant into the mold, and the spraying of the lubricant through the pipe is hardly conducted and also the formation of lubricating film and release properties of the film are degraded which result in the galling, sticking and the like.

As the alkali metal salts of isophthalic acid and adipic acid used in the invention, when the total amount of the alkali metal salt is less than 0.1% by weight, good lubricity is not obtained, while when it exceeds 30% by weight, the concentration of the alkali metal salt becomes too high and a stable lubricant can not be obtained. Therefore, the total amount of the alkali metal salt used should be within a range of 0.1–30% by weight. As the alkali metal, use may be made of sodium and potassium.

In the invention, the water-soluble high polymer is used for ensuring the dispersibility of the resin powder. When the amount of the polymer added is less than 0.1% by weight, the dispersibility of the resin powder is poor and settlement of the resin powder is makes it hard to produce a stable lubricant, while when it exceeds 10% by weight, the viscosity of the lubricant becomes too high and hence the handling becomes poor in use, so that the amount of the polymer added should be within a range of 0.1–10% by weight. As the polymer, use may be made of carboxymethyl cellulose, sodium polycarboxylate, copolymer of isobutylene and maleic anhydrate, polyvinyl alcohol and the like.

The water-soluble lubricant for hot plastic working according to the invention is prepared by charging the given components into a proper vessel and preliminarily mixing them therein and then placing in a proper batch mixer such as a ball mill and thoroughly mixing at room temperature under atmospheric pressure without requiring a special device a special method.

In use, the thus obtained water-soluble lubricant is further diluted with water to form an aqueous solution having a resin powder content of 0.1–3% by weight, which is applied to a mold by spraying or with a brush.

The following examples are given in illustration of the invention and are not intended as limitations thereof.

EXAMPLE 1

The following components are compounded at the following compounding amounts and thoroughly mixed in a ball mill for laboratory at room temperature to obtain a water-soluble lubricant.

| | |
|---|---|
| Acrylic resin powder (made by Mitsubishi Rayon Co., Ltd.) | 1 kg |
| Carboxymethyl cellulose (made by Nichirin Kagaku Kogyo K.K.) | 600 g |
| Isophthalic acid | 2.2 kg |
| Adipic acid | 2.2 kg |
| Sodium hydroxide | 2.35 kg |
| Water | 11.65 kg |

The particle size distribution of the above acrylic resin powder is measured by means of Horiba-type centrifugal automatic measuring device for particle size distribution CAPA-500 to obtain results as shown in Table 1, in which D is a particle size and F is a weight percentage of particles in each particle size zone.

TABLE 1

| D (μm) | 10.00< | 10.00~1.00 | 1.00~0.10 | 0.10~0.00 |
|---|---|---|---|---|
| F (%) | 4.5 | 76.4 | 18.1 | 1.0 |

The performance of the thus obtained water-soluble lubricant is evaluated by diluting the lubricant with water 15 times, spraying the diluted lubricant to a forging mold heated to about 150°–400° C. in a press machine of 1600 t and then hot-forging S45C steel sheet heated to about 1150°–1200° C. therein. Even after the repetition of the hot forging about 10,000 times, a good result is obtained without sticking and galling.

EXAMPLE 2

A water-soluble lubricant is prepared in the same manner as described in Example 1 by using the following components:

| | |
|---|---|
| Powder of melamine cyanurate resin (made by Nissan Chemical Industries, Ltd.) | 1 kg |
| Carboxymethyl cellulose (made by Nichirin Kagaku Kogyo K.K.) | 1 kg |
| Isophthalic acid | 2.2 kg |
| Adipic acid | 2.2 kg |
| Sodium hydroxide | 2.35 kg |
| Water | 11.25 kg |

The particle size distribution of the above resin powder is measured by the same method as in Example 1 to obtain results as shown in Table 2.

TABLE 2

| D (μm) | 10.00< | 10.00~1.00 | 1.00~0.10 | 0.10~0.00 |
|---|---|---|---|---|
| F (%) | 0.0 | 41.5 | 56.2 | 2.3 |

The thus obtained water-soluble lubricant is diluted with water 20 times, sprayed to a forging mold heated to about 150°–300° C. in a press machine of 2000 t, and then hot-forging of S35C steel sheet heated to about 1150°–1200° C. is conducted therein. Even after the repetition of the hot forging about 10,000 times, a good result is obtained without sticking, galling and deposition onto the mold.

EXAMPLE 3

A water-soluble lubricant is prepared in the same manner as described in Example 1 by using the following components:

| | |
|---|---|
| Powder of allyl resin (made by Daiso K.K.) | 600 g |
| Carboxymethyl cellulose (made by Nichirin Kagaku Kogyo K.K.) | 600 g |
| Isophthalic acid | 3.4 kg |
| Adipic acid | 1 kg |
| Sodium hydroxide | 2.35 kg |
| Water | 12.05 kg |

The particle size distribution of the above resin powder is measured by the same method as in Example 1 to obtain results as shown in Table 3.

TABLE 3

| D (μm) | 10.00< | 10.00~1.00 | 1.00~0.10 | 0.10~0.00 |
|---|---|---|---|---|
| F (%) | 3.0 | 70.3 | 26.2 | 0.5 |

The thus obtained water-soluble lubricant is diluted with water 10 times, sprayed to a forging mold heated to about 150°–300° C. in a press machine of 1600 t, and then hot-forging of SCr420 steel sheet heated to about 1150°–1200° C. is conducted therein. Even after the repetition of the hot forging about 8,000 times, a good result is obtained without sticking, galling and deposition onto the mold.

EXAMPLE 4

A water-soluble lubricant is prepared in the same manner as described in Example 1 by using the following components:

| | |
|---|---|
| Powder of polyethylene resin (made by Sumitomo Seika K.K.) | 1 kg |
| Carboxymethyl cellulose (made by Nichirin Kagaku Kogyo K.K.) | 600 g |
| Isophthalic acid | 2.2 kg |
| Adipic acid | 2.2 kg |
| Sodium hydroxide | 2.35 kg |
| Water | 11.65 kg |

The particle size distribution of the above resin powder is measured by the same method as in Example 1 to obtain results as shown in Table 4.

TABLE 4

| D (μm) | 10.00< | 10.00~1.00 | 1.00~0.10 | 0.10~0.00 |
|---|---|---|---|---|
| F (%) | 2.5 | 81.3 | 14.7 | 1.5 |

The thus obtained water-soluble lubricant is diluted with water 15 times, sprayed to a forging mold heated to about 150°-300° C. in a press machine of 1600 t, and then hot-forging of S35C steel sheet heated to about 1150°-1200° C. is conducted therein. Even after the repetition of the hot forging about 7,000 times, a good result is obtained without sticking, galling and deposition onto the mold.

EXAMPLE 5

A water-soluble lubricant is prepared in the same manner as described in Example 1 by using the following components:

| | |
|---|---|
| Powder of cellulose resin (made by Sanyo-Kokusaku Pulp Co., Ltd.) | 1 kg |
| Sodium polyacrylate | 400 g |
| Isophthalic acid | 2.2 kg |
| Adipic acid | 2.2 kg |
| Sodium hydroxide | 2.35 kg |
| Water | 11.85 kg |

The particle size distribution of the above resin powder is measured by the same method as in Example 1 to obtain results as shown in Table 5.

TABLE 5

| D (μm) | 10.00< | 10.00~1.00 | 1.00~0.10 | 0.10~0.00 |
|---|---|---|---|---|
| F (%) | 2.5 | 90.2 | 6.5 | 0.8 |

The thus obtained water-soluble lubricant is diluted with water 20 times, sprayed to a forging mold heated to about 150°-300° C. in a press machine of 1600 t, and then hot-forging of SCr420 steel sheet heated to about 1150°-1200° C. is conducted therein. Even after the repetition of the hot forging about 10,000 times, a good result is obtained without sticking, galling and deposition onto the mold.

EXAMPLE 6

A water-soluble lubricant is prepared in the same manner as described in Example 1 by using the following components:

| | |
|---|---|
| Powder of allyl resin (made by Daiso K.K.) | 4 kg |
| Carboxymethyl cellulose (made by Nichirin Kagaku Kogyo K.K.) | 1.5 kg |
| Isophthalic acid | 1.1 kg |
| Adipic acid | 1.1 kg |
| Sodium hydroxide | 1.175 kg |
| Water | 11.125 kg |

The particle size distribution of the above resin powder is measured by the same method as in Example 1 to obtain results as shown in Table 6.

TABLE 6

| D (μm) | 10.00< | 10.00~1.00 | 1.00~0.10 | 0.10~0.00 |
|---|---|---|---|---|
| F (%) | 3.0 | 70.3 | 26.2 | 0.5 |

The thus obtained water-soluble lubricant is diluted with water 20 times, sprayed to a forging mold heated to about 150°-300° C. in a press machine of 1600 t, and then hot-forging of SCr420 steel sheet heated to about 1150°-1200° C. is conducted therein. Even after the repetition of the hot forging about 7,000 times, a good result is obtained without sticking, galling and deposition onto the mold.

EXAMPLE 7

A water-soluble lubricant is prepared in the same manner as described in Example 1 by using the following components:

| | |
|---|---|
| Powder of allyl resin (made by Daiso K.K.) | 1 kg |
| Copolymer of isobutylene and maleic anhydride (Inban, trade name, made by Kuraray Co., Ltd.) | 250 g |
| Isophthalic acid | 1 kg |
| Adipic acid | 3.4 kg |
| Sodium hydroxide | 2.5 kg |
| Water | 11.85 kg |

The particle size distribution of the above resin powder is measured by the same method as in Example 1 to obtain results as shown in Table 7.

TABLE 7

| D (μm) | 10.00< | 10.00~1.00 | 1.00~0.10 | 0.10~0.00 |
|---|---|---|---|---|
| F (%) | 4.0 | 72.5 | 22.7 | 0.8 |

The thus obtained water-soluble lubricant is diluted with water 15 times, sprayed to a forging mold heated to about 150°-300° C. in a press machine of 1600 t, and then hot-forging of SCr420 steel sheet heated to about 1150°-1200° C. is conducted therein. Even after the repetition of the hot forging about 7,000 times, a good result is obtained without sticking, galling and deposition onto the mold.

As mentioned above, according to the invention, a mixed solution of the components (a) to (c) and water is used as a water-soluble lubricant for hot plastic working, whereby the lubricity and releasing properties are considerably improved as compared with those of the conventionally used white lubricant and are equal to those of the conventional graphite-based lubricant. Further, the working environment is improved because the lubricant is white. Moreover, since the lubricant according to the invention contains the resin powder, even if it is sprayed to a mold at a low temperature (about 150° C.) a good lubricating film is formed without flowing.

What is claimed is:

1. A water-soluble lubricant for hot plastic working consisting essentially of (a) 0.1-30% by weight of a resin powder having a particle size distribution that an average particle size is 0.1-10 μm and an amount of particles having a particle size of not more than 0.1 μm is not more than 5% by weight and an amount of particles having a particle size of not less than 10 μm is not more than 5% by weight, (b) 0.1-30% by weight in total of alkali metal salts of isophthalic acid and adipic acid, (c) 0.1-10% by weight of a water-soluble high polymer, and (d) the balance being water.

2. A water-soluble lubricant according to claim 1, wherein said resin powder is selected from cellulose resin, acrylic resin, polyethylene resin, epoxy resin, phenolic resin, polyester resin, allyl resin and melamine cyanurate resin.

3. A water-soluble lubricant according to claim 1, wherein an alkali metal used in said alkali metal salt is sodium or potassium.

4. A water-soluble lubricant according to claim 1, wherein said polymer is selected from carboxymethyl cellulose, sodium polycarboxylate, copolymer of isobutylene and maleic anhydrate and polyvinyl alcohol.

5. A process for lubricating a mold to prevent sticking of a substrate in the mold during a hot forging operation, said process comprising the following steps:

a) coating the mold with a lubricating composition as claimed in claim 1;

b) depositing the substrate into the coated mold;

c) hot forging the substrate in the mold; and d) removing the hot forged substrate from the mold.

6. A process for lubricating a mold as claimed in claim 5 wherein the mold is at a temperature of between about 150°–300° C. during the coating step a.

7. A process for lubricating a mold as claimed in claim 6 wherein the hot forging of step c is conducted at a temperature of between about 1150°–1200° C.

8. A process for lubricating a mold as claimed in claim 5 wherein the substrate is steel.

* * * * *